US009556861B2

(12) United States Patent
Suzuki et al.

(10) Patent No.: US 9,556,861 B2
(45) Date of Patent: Jan. 31, 2017

(54) VARIABLE DISPLACEMENT SWASH PLATE COMPRESSOR

(71) Applicant: KABUSHIKI KAISHA TOYOTA JIDOSHOKKI, Aichi-ken (JP)

(72) Inventors: Takahiro Suzuki, Kariya (JP); Masaki Ota, Kariya (JP); Shinya Yamamoto, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Aichi-Ken ( * ) Notice: Subject to any disclaimer, the term of this patent is extended or adjusted under 35 U.S.C. 154(b) by 346 days.

(21) Appl. No.: 14/224,422

(22) Filed: Mar. 25, 2014

(65) Prior Publication Data

US 2014/0294613 A1 Oct. 2, 2014

(30) Foreign Application Priority Data

Mar. 29, 2013 (JP) ..... 2013-070750

(51) Int. Cl.
*F04B 27/18* (2006.01)
*F04B 27/10* (2006.01)

(52) U.S. Cl.
CPC ..... *F04B 27/1804* (2013.01); *F04B 27/1009* (2013.01); *F04B 27/109* (2013.01); *F04B 27/18* (2013.01); *F04B 2027/1831* (2013.01)

(58) Field of Classification Search
CPC ..... F04B 27/18; F04B 2027/1831
See application file for complete search history.

(56) References Cited

U.S. PATENT DOCUMENTS 4,037,993 A 7/1977 Roberts
5,370,503 A 12/1994 Terauchi
5,580,224 A 12/1996 Ikeda et al.
(Continued)

FOREIGN PATENT DOCUMENTS

CN 1082150 2/1994
CN 1115010 1/1996
(Continued)

OTHER PUBLICATIONS

Search report from E.P.O., mail date is Jul. 21, 2014.
Office Action issued in China Counterpart Patent Appl. No. 201410116601.9, dated Oct. 30, 2015.

*Primary Examiner* — Patrick Hamo
(74) *Attorney, Agent, or Firm* — Greenblum & Bernstein, P.L.C.

(57) ABSTRACT

A variable displacement swash plate compressor that includes a cylinder bore, a swash plate chamber, a swash plate, and a double head piston, which defines first and second compression chambers in the cylinder bore. First and second suction chambers are in communication with the first and second compression chambers, respectively. The displacement of the top dead center of the piston in the first compression chamber is greater than the displacement of the top dead center of the piston in the second compression chamber. A first suction passage extends from a suction port to the first suction chamber without passing through the second suction chamber and the swash plate chamber. A second suction passage extends from the first suction chamber to the second suction chamber.

3 Claims, 4 Drawing Sheets

(56) References Cited

U.S. PATENT DOCUMENTS

| | | | |
|---|---|---|---|
| 6,164,929 | A | 12/2000 | Kazuya et al. |
| 6,394,763 | B1 | 5/2002 | Harte et al. |
| 6,402,480 | B1 | 6/2002 | Sud et al. |
| 2002/0081214 | A1 | 6/2002 | Huang et al. |
| 2009/0145293 | A1 | 6/2009 | Kawachi et al. |

FOREIGN PATENT DOCUMENTS

| | | | | |
|---|---|---|---|---|
| CN | 2007-239722 | | 9/2007 | |
| CN | 101451518 | | 6/2009 | |
| JP | 1-219364 | | 9/1989 | |
| JP | 1-232180 | | 9/1989 | |
| JP | 04-191472 | | 7/1992 | |
| JP | 7-14171 | | 3/1995 | |
| JP | 2641477 | B2 * | 8/1997 | ..... F04B 27/08 |
| JP | 2007-239722 | | 9/2007 | |

* cited by examiner

VARIABLE DISPLACEMENT SWASH PLATE COMPRESSOR

BACKGROUND OF THE INVENTION

The present invention relates to a variable displacement swash plate compressor.

Japanese Laid-Open Patent Publication No. 1-219364 describes an example of a variable displacement swash plate compressor. The compressor includes a cylinder housing, which includes a cylinder chamber, a shaft, which is rotatably supported in the cylinder housing, a swash plate, which rotates integrally with the shaft, and a piston, which reciprocates in the cylinder chamber. First and second compression chambers are arranged at the opposite ends of the piston. The first and second compression chambers draw in fluid, compresses the fluid, and discharges the compressed fluid. The compressor also includes a support member arranged coaxially with the shaft. The support member pivotally supports the swash plate. The support member moves the central portion of the swash plate along the axis of the shaft and changes the inclination of the swash plate. In the first compression chamber, the corresponding piston is movable to positions where the piston draws in, compresses, and discharges fluid regardless of the inclination of the swash plate. The second compression chamber includes a dead space the volume of which changes in accordance with the inclination of the swash plate. The compressor further includes first, second, and third suction passages. The first suction passage guides fluid into a second suction chamber that is in communication with each second compression chamber. The second suction passage guides fluid into a first suction chamber that is in communication with each first compression chamber. The third suction passage allows the fluid to be sent to the second suction chamber bypassing the first suction passage.

The first and second suction passages of the compressor disclosed in the publication allows the fluid to first flow toward the second suction chamber. Thus, the fluid circulates over a large area in the compressor and effectively cools and lubricates each portion of the compressor. In addition, the third suction passage allows the fluid to be sent to the first suction chamber bypassing the first suction passage. This ensures that a large amount of fluid is sent to the first and second suction chambers when the compressor operates under a maximum displacement condition.

However, in the compressor of the publication, the drawn in fluid would have to pass through the swash plate chamber and a shaft sealing device before reaching the first and second chambers. The swash plate chamber accommodates sliding parts such as the swash plate, and the shaft sealing device also includes a sliding part. These sliding parts act as heat sources that heat the suction fluid. The heated drawn in fluid reduces the compression efficiency. In particular, the sliding parts including the swash plate generate more heat during a large displacement operation. This increases the temperature of the drawn in fluid and adversely affects the compression efficiency.

SUMMARY OF THE INVENTION

It is an object of the present disclosure to provide a variable displacement swash plate compressor that ensures lubrication of sliding parts regardless of the level of displacement and improves the compression efficiency by limiting increases in the refrigerant temperature during a large displacement operation.

To achieve the above object, one aspect of the present invention is a variable displacement swash plate compressor that includes a housing including a cylinder bore and a swash plate chamber, a drive shaft rotatably supported in the housing, and a link mechanism that rotates integrally with the drive shaft. A swash plate is accommodated in the swash plate chamber and adapted to rotate when receiving driving force from the drive shaft through the link mechanism. The inclination angle of the swash plate to the drive shaft is variable. A double head piston is movably arranged in the cylinder bore and adapted to reciprocate in the cylinder bore and compress refrigerant when the swash plate rotates. The double head piston includes a first end that defines a first compression chamber in the cylinder bore and a second end that defines a second compression chamber in the cylinder bore. A first suction chamber is located in the housing and in communication with the first compression chamber. A second suction chamber is arranged in the housing and in communication with the second compression chamber. The drive shaft includes an input end section extending from the second suction chamber toward outside of the housing. A shaft sealing device is arranged between the input end section of the drive shaft and the housing and adapted to limit leakage of refrigerant out of the housing from the second suction chamber. The link mechanism is adapted to support the swash plate in a manner that allows for variation in the inclination angle of the swash plate. According to the variation in the inclination angle of the swash plate, a top dead center of the double head piston in the first compression chamber is displaced and a top dead center of the double head piston in the second compression chamber is displaced. The displacement of the top dead center in the first compression chamber is greater than the displacement of the top dead center in the second compression chamber. A suction port is located in the housing. Refrigerant is drawn into the housing through the suction port from outside of the housing. A first suction passage extends from the suction port to the first suction chamber without passing through the second suction chamber and the swash plate chamber. A second suction passage extends from the first suction chamber to the second suction chamber.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

A variable displacement swash plate compressor (hereinafter referred to as compressor) of one embodiment will now be described with reference to the drawings.

Figure 1:
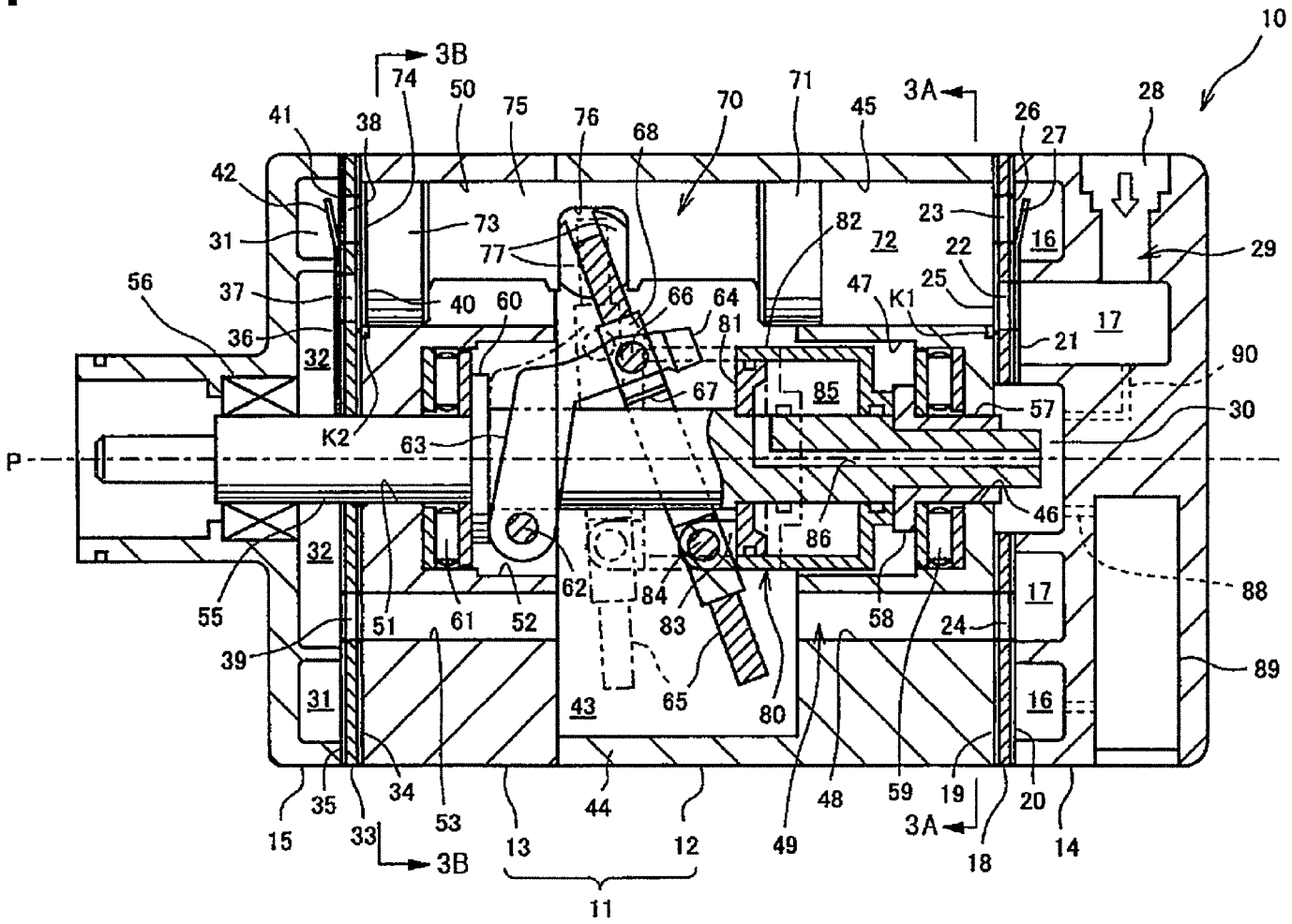
FIG. 1 is a cross-sectional view showing a variable displacement swash plate compressor of one embodiment.

As shown in FIG. 1, a compressor 10 includes a cylinder block 11 that includes a first cylinder block member 12 and a second cylinder block member 13 coupled to the first cylinder block member 12. The first cylinder block member 12 includes a plurality of primary cylinder bores 45 (only one shown in FIG. 1), and the second cylinder block member 13 includes a plurality of secondary cylinder bores 50 (only one shown in FIG. 1). The first cylinder block member 12 includes an end coupled to a first housing member 14 that is located on the rear side. The second cylinder block member 13 includes an end coupled to a second housing member 15 that is located on the front side. The first and second cylinder block members 12 and 13 and the first and second housing members 14 and 15 are fastened together by bolts (not shown) and form a housing of the compressor 10.

The first housing member 14 includes a first discharge chamber 16 and a first suction chamber 17. The first discharge chamber 16 surrounds the first suction chamber 17 in the radial direction of the first housing member 14. A first valve plate 18, a first suction valve plate 19, a first discharge valve plate 20, and a first retainer plate 21 are arranged between the first cylinder block member 12 and the first housing member 14.

Figure 2A:
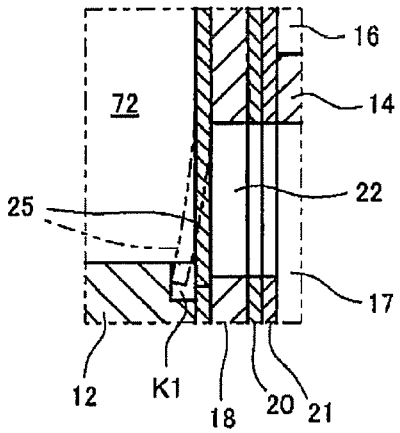
FIG. 2A is an enlarged cross-sectional view showing a first suction valve.

The first valve plate 18 includes primary suction ports 22, primary discharge ports 23, and communication holes 24. The first suction valve plate 19 includes primary suction valves 25, which are reed valves that open and close the respective primary suction ports 22. As shown in FIG. 2A, the first cylinder block member 12 includes cut out parts K1 that are in communication with the respective primary cylinder bores 45. Each cut out part K1 sets the maximum open degree of the corresponding primary suction valve 25.

The first discharge valve plate 20 includes primary discharge valves 26 that open and close the respective primary discharge ports 23. The first retainer plate 21 includes primary retainers 27, and each primary retainer 27 sets the maximum open degree of the corresponding primary discharge valve 26. The first housing member 14 includes a suction port 28 that communicates an external refrigerant circuit (not shown) and the first suction chamber 17. A first suction passage 29 extends between the suction port 28 and the first suction chamber 17. The first housing member 14 includes a central section including a recess that serves as a pressure adjustment chamber 30.

The second housing member 15 includes a second discharge chamber 31 and a second suction chamber 32. The second discharge chamber 31 surrounds the second suction chamber 32 in the radial direction of the second housing member 15. A second valve plate 33, a second suction valve plate 34, a second discharge valve plate 35, and a second retainer plate 36 are arranged between the second cylinder block member 13 and the second housing member 15.

Figure 2B:
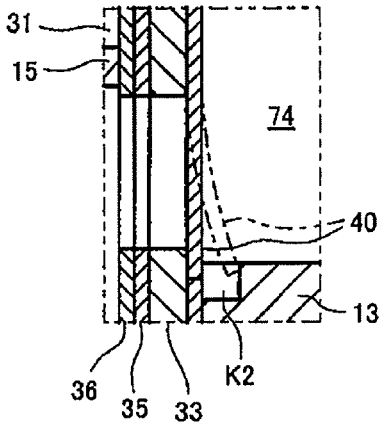
FIG. 2B is an enlarged cross-sectional view showing a second suction valve.

The second valve plate 33 includes secondary suction ports 37, secondary discharge ports 38, and communication holes 39. The second suction valve plate 34 includes secondary suction valves 40, which are reed valves that open and close the respective secondary suction ports 37. As shown in FIG. 2B, the second cylinder block member 13 includes cut out parts K2 that are in communication with the respective secondary cylinder bores 50. Each cut out part K2 sets the maximum opening degree of the corresponding secondary suction valve 40. The maximum open degree of each secondary suction valve 40 is greater than the maximum open degree of each primary suction valve 25. Specifically, the difference between the maximum open degrees of the primary suction valve 25 and the secondary suction valve 40 is set to be greater than the dimensional tolerance in the thickness of the primary suction valve 25 by setting the axial length of the cut out portion K2 to be greater than the axial length of the cut out port K1. The valve lift of the secondary suction valve 40 is set to be greater than the valve lift of the primary suction valve 25 by 0.1 mm or more, for example.

The second discharge valve plate 35 includes secondary discharge valves 41 that open and close the respective secondary discharge ports 38. The second retainer plate 36 includes secondary retainers 42, and each retainer 42 sets the maximum open degree of the corresponding second discharge valve 41.

Figure 3A:
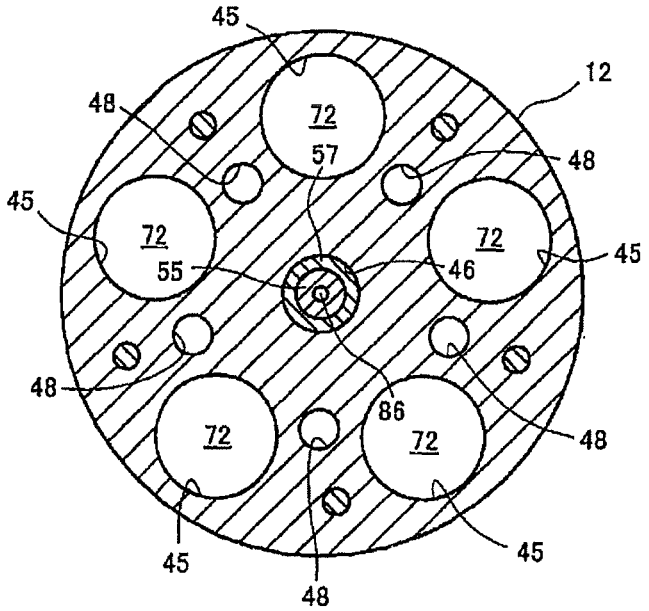
FIG. 3A is a cross-sectional view taken along line 3A-3A in FIG. 1.

A swash plate chamber 43 is formed between the first cylinder block member 12 and the second cylinder block member 13. The first cylinder block member 12 includes a cylindrical wall 44 that forms the circumferential wall of the swash plate chamber 43. As shown in FIG. 3A, the primary cylinder bores 45 are arranged in a circle at equal angular intervals and extend in parallel. The compressor 10 of the present embodiment is a ten-cylinder compressor and includes five primary cylinder bores 45 in the first cylinder block member 12.

The first cylinder block member 12 includes a first shaft hole 46 extending through the central section of the first cylinder block member 12. As shown in FIG. 1, a first cavity 47 is arranged at the end of the first shaft hole 46 that faces toward the second cylinder block member 13. The first cavity 47 is coaxial with the first shaft hole 46 and has a larger diameter than the first shaft hole 46. The first cylinder block member 12 includes a plurality of communication passages 48 that are in communication with the respective communication holes 24 of the first valve plate 18. Accordingly, the communication holes 24 and the communication passages 48 communicate the swash plate chamber 43 and the first suction chamber 17.

Figure 3B:
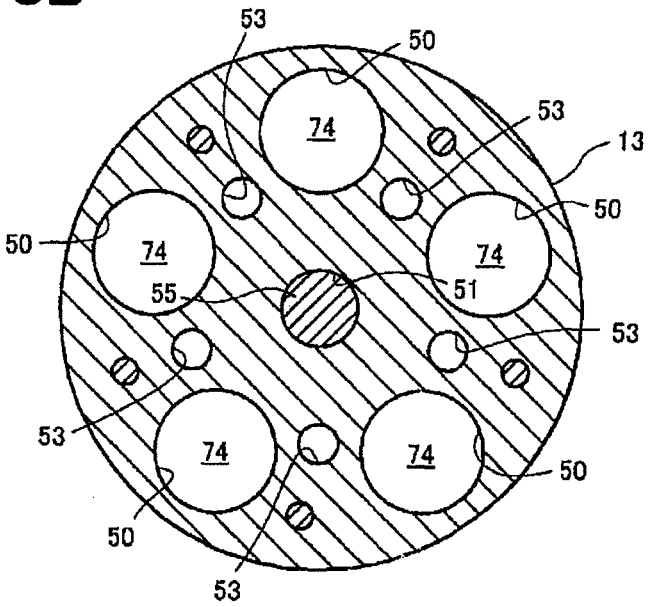
FIG. 3B is a cross-sectional view taken along line 3B-3B in FIG. 1.

As shown in FIG. 3B, in the same manner as the primary cylinder bores 45, the secondary cylinder bores 50 are arranged along a circle at equal angular intervals and extend in parallel. The secondary cylinder bores 50 are arranged coaxially with the respective primary cylinder bores 45. Thus, the second cylinder block member 13 includes five secondary cylinder bores 50.

The second cylinder block member 13 includes a second shaft hole 51 that is coaxial with the first shaft hole 46 of the first cylinder block member 12. The second shaft hole 51 extends through the central section of the second cylinder block member 13. A second cavity 52 is arranged at the end of the second shaft hole 51 that faces toward the first cylinder block member 12. The second cavity 52 is coaxial with the second shaft hole 51 and has a larger diameter than the second shaft hole 51. The second cylinder block member 13 includes a plurality of communication passages 53 that is in communication with the respective communication holes 39 of the second valve plate 33. Accordingly, the communication holes 39 and the communication passages 53 communicate the swash plate chamber 43 and the second suction chamber 32. The communication passages 48, the swash plate chamber 43 and the communication passages 53 form a second suction passage 49 extending from the first suction chamber 17 to the second suction chamber 32.

The first and second shaft holes 46 and 51 receive a drive shaft 55 that is rotatably supported by the first and second cylinder block members 12 and 13. The drive shaft 55 includes an input end that extends through the second housing member 15 and is connected to a rotation drive source outside the compressor 10. In addition, the drive shaft 55 includes an input end section that extends from the second suction chamber 32 toward the outside of the housing. A shaft sealing device 56 is arranged between the second housing member 15 and the input end section of the drive shaft 55. The shaft sealing device 56 seals the second suction chamber 32 so that refrigerant does not leak out of the second suction chamber 32. The shaft sealing device 56 is arranged in the second housing member 15, which does not include the suction port 28.

The other end of the drive shaft 55 is fitted into a cylindrical member 57 and extends to the pressure adjustment chamber 30. The cylindrical member 57 rotates integrally with the drive shaft 55 and includes a flange 58, which is located in the first cavity 47. The first cavity 47 accommodates a thrust bearing 59 located at the side of the flange 58 that faces toward the first housing member 14. The drive shaft 55 includes a flange 60 that is located in the second cavity 52. A thrust bearing 61 is arranged at the side of the flange 60 that faces toward the second shaft hole 51.

A lug arm 63 is coupled to the drive shaft 55 by a coupling pin 62. The lug arm 63 is located at the side of the flange 60 that faces toward the first cylinder block member 12. The lug arm 63 pivots about the coupling pin 62 with respect to the axis P of the drive shaft 55. In the following description, the term "axial direction" refers to the direction of the axis P of the drive shaft 55. The lug arm 63 functions as a link mechanism that rotates integrally with the drive shaft 55. The distal end of the lug arm 63 includes a weight 64. The section of the lug arm 63 proximal to the weight 64 is coupled to a swash plate 65 in the swash plate chamber 43 by a coupling pin 66.

The swash plate 65 is a disk that includes a shaft receiving hole 67, which receives the drive shaft 55, and an arm receiving hole 68, which receives the distal end of the lug arm 63. The swash plate 65 is located at the side of the lug arm 63 that faces toward the first cylinder block member 12. The pivoting of the lug arm 63 allows the swash plate 65 to tilt and move with respect to the axis P.

A double head piston 70 is arranged in each pair of the primary and secondary cylinder bores 45 and 50 in a manner that allows the double head piston 70 to reciprocate and move relative to the cylinder block 11. The double head piston 70 includes first and second heads 71 and 73 and a middle portion 75 arranged between the first and second heads 71 and 73. The first head 71 defines a first compression chamber 72 in the primary cylinder bore 45. The second head 73 defines a second compression chamber 74 in the secondary cylinder bore 50. The first and second heads 71 and 73 are also referred to as first and second ends of the double head piston 70. The middle portion 75 includes a central section that includes a recess 76. Two spherical shoes 77 are arranged in the recess 76. The outer circumferential portion of the swash plate 65 is located between the shoes 77 and moves relative to the shoes 77. Thus, the swash plate 65 and the shoes 77 function as a conversion mechanism that converts the rotation of the drive shaft 55 into the reciprocation of the double head pistons 70.

The first cavity 47 accommodates an actuator 80 located at the side of the flange 58 that faces toward the swash plate chamber 43. The actuator 80 includes a fixed body 81, which is fixed to the drive shaft 55, and a movable body 82, which is movable in the axial direction. The fixed body 81 has the form of a circular plate, and the movable body 82 is cylindrical. The movable body 82 includes a coupler 83 that projects toward the swash plate 65. The coupler 83 is coupled to the swash plate 65 by a coupling pin 84. Thus, the axial movement of the swash plate 65 moves the movable body 82 in the axial direction. The fixed body 81 is always located in the movable body 82, and the movable body 82 and the fixed body 81 form a control pressure chamber 85. The control pressure chamber 85 has a volume that varies in accordance with the reciprocating axial movement of the movable body 82.

The drive shaft 55 includes a passage 86 that communicates the control pressure chamber 85 and the pressure adjustment chamber 30. Thus, the movable body 82 moves in accordance with the pressure difference between the control pressure chamber 85 and the swash plate chamber 43. Since the inclination of the swash plate 65 relative to the drive shaft 55 is variable, movement of the movable body 82 moves the swash plate 65 in the axial direction and changes the inclination of the swash plate 65. The inclination of the swash plate 65 is the angle that the surface of the swash plate 65 forms with a plane perpendicular to the axis of the drive shaft 55. The inclination is largest in a maximum displacement operation of the compressor 10 and smallest in a minimum displacement operation. In FIG. 1, the swash plate 65 during a maximum displacement operation is indicated by the solid lines, and the swash plate 65 during a minimum displacement operation is indicated by the double-dashed lines.

In the compressor 10 of the present embodiment, the first housing member 14 includes a supply passage 88 that communicates the first discharge chamber 16 and the pressure adjustment chamber 30. A displacement control valve 89 is arranged in the supply passage 88. In addition, the first housing member 14 includes a bleed passage 90 that includes a throttle (not shown), which communicates the pressure adjustment chamber 30 and the first suction chamber 17. The displacement control valve 89 adjusts the amount of high-pressure refrigerant supplied to the pressure adjustment chamber 30. Thus, operation of the displacement control valve 89 adjusts the pressure in the pressure adjustment chamber 30. The adjustment of the pressure in the pressure adjustment chamber 30 adjusts the pressure in the control pressure chamber 85. The movable body 82 of the actuator 80 moves in accordance with the pressure difference between the control pressure chamber 85 and the swash plate chamber 43. The movement of the movable body 82 changes the inclination of the swash plate 65. This changes the stroke of the double head piston 70. Accordingly, the displacement of the compressor 10 is controlled.

The operation of the compressor 10 will now be described. The drive shaft 55 rotates when receiving driving force from the driving source. This rotates the lug arm 63. The rotation of the swash plate 65, which rotates integrally with the drive shaft 55 by way of the lug arm 63, is transmitted to the double head piston 70 through the shoes 77. This reciprocates the double head piston 70 in the primary and secondary cylinder bores 45 and 50. The reciprocation of the double head piston 70 draws refrigerant of suction pressure in the external refrigerant circuit into the first suction chamber 17 through the suction port 28. Some of the refrigerant drawn into the first suction chamber 17 is then drawn into the first compression chamber 72 in suction phases in which the first head 71 moves from the top dead center to the bottom dead center. The refrigerant drawn into the first compression chamber 72 is compressed in compression phases in which the first head 71 moves form the bottom dead center to the top dead center. The compressed refrigerant is discharged to the first discharge chamber 16.

Some of the refrigerant drawn into the first suction chamber 17 is sent to the swash plate chamber 43 through the communication holes 24 and the communication passages 48. The refrigerant is then sent from the swash plate chamber 43 to the second suction chamber 32 through the communication passages 53 and the communication holes 39. The refrigerant drawn into the second suction chamber 32 is then drawn into the second compression chamber 74 in suction phases in which the second head 73 moves from the top dead center to the bottom dead center. The refrigerant drawn into the second compression chamber 74 is compressed in compression phases in which the second head 73 moves from the bottom dead center to the top dead center. The compressed refrigerant is discharged to the second discharge chamber 31. The discharge pressure refrigerant that is discharged to the first discharge chamber 16 and the second discharge chamber 31 is then discharged to the external refrigerant circuit.

Figure 4A:
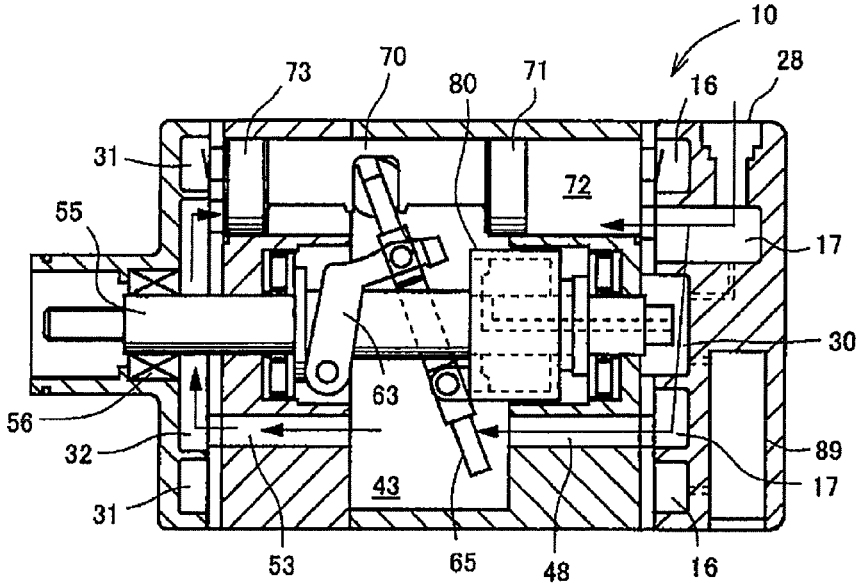
FIG. 4A is a cross-sectional view showing a flow of refrigerant during a maximum displacement operation of a variable displacement swash plate compressor.

The pressure in the control pressure chamber 85 increases when the amount of the discharge pressure refrigerant flowing through the supply passage 88 is increased by operation of the displacement control valve 89, for example. When the pressure in the control pressure chamber 85 exceeds the pressure in the swash plate chamber 43, the movable body 82 of the actuator 80 moves into the first cavity 47. This increases the inclination of the swash plate 65. As shown in FIG. 4A, the maximum inclination of the swash plate 65 maximizes the strokes of the first and second heads 71 and 73 of the double head piston 70. Thus, the compressor 10 operates with the largest displacement. Here, the refrigerant fed to the suction port 28 from the external refrigerant circuit is sent to the first suction chamber 17 through the first suction passage 29 and drawn into the first compression chamber 72 in suction phases. The refrigerant drawn into the first compression chamber 72 is hardly heated since the refrigerant is sent from the suction port 28 to the first suction chamber 17 through the first suction passage 29, which does not extend through the swash plate chamber 43 or the second suction chamber 32. This minimizes increases in the refrigerant temperature. The refrigerant drawn into the first compression chamber 72 includes lubricating oil that lubricates the sliding surfaces of the inner surface of the primary cylinder bore 45 and the first head 71.

Some of the refrigerant fed to the suction port 28 from the external refrigerant circuit is sent to the second suction chamber 32, which faces the shaft sealing device 56, through the first suction passage 29, the first suction chamber 17, and the second suction passages 49, which extend through the swash plate chamber 43. The refrigerant is then drawn into the second compression chamber 74 in suction phases. That is, the refrigerant flows through the swash plate chamber 43 and the second suction chamber 32, which faces the shaft sealing device 56, before reaching the second compression chamber 74. The refrigerant and lubricating oil in the refrigerant cool and lubricate the sliding parts including the shaft sealing device 56 and the swash plate 65, the shoes 77, the lug arm 63, and the actuator 80 in the swash plate chamber 43. Thus, the heat of the shaft sealing device 56 and the sliding parts in the swash plate chamber 43 increases the temperature of the refrigerant. The lubricating oil in the refrigerant drawn into the second compression chamber 74 lubricates the sliding surfaces of the inner surface of the secondary cylinder bore 50 and the second head 73.

Figure 4B:
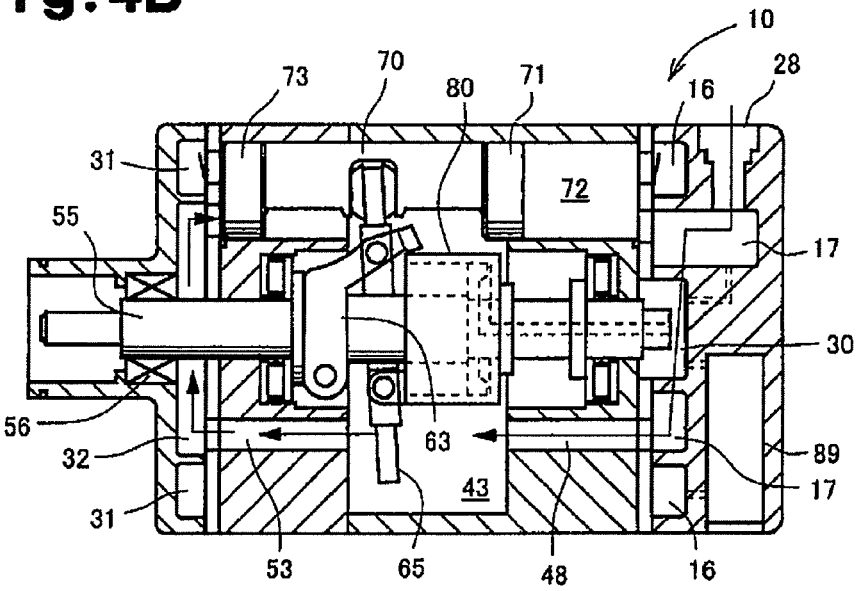
FIG. 4B is a cross-sectional view showing a flow of refrigerant during a minimum displacement operation of the variable displacement swash plate.

When the amount of discharge pressure refrigerant flowing in the supply passage 88 is decreased by the operation of the displacement control valve 89, the pressure in the control pressure chamber 85 decreases. When the pressure in the control pressure chamber 85 becomes lower than the pressure in the swash plate chamber 43, the movable body 82 of the actuator 80 moves away from the first cavity 47, reducing the inclination of the swash plate 65. As shown in FIG. 4B, the minimum inclination, which is approximately zero degree, of the swash plate 65 minimizes the strokes of the first and second heads 71 and 73 of the double head piston 70. Thus, the compressor 10 operates with the minimum displacement. In a minimum displacement operation, the stroke of the first head 71 is limited to the range from the bottom dead center to a position slightly separated from the bottom dead center toward the top dead center. Further, the stroke of the second head 73 is limited to the range from the top dead enter to a position slightly separated from the top dead center toward the bottom dead center. Thus, in the minimum displacement operation, the primary cylinder bore 45 includes the first compression chamber 72 that has a larger dead volume than the second compression chamber 74. The secondary cylinder bore 50 includes the second compression chamber 74 that is significantly smaller than the first compression chamber 72.

During the minimum displacement operation, the refrigerant in the first compression chamber 72 is repeatedly compressed and expanded with no refrigerant being drawn into or discharged from the first compression chamber 72. A small amount of refrigerant is drawn into and compressed in the second compression chamber 74, and the compressed refrigerant is discharged to the second discharge chamber 31. Thus, refrigerant constantly flows through the second suction passage 49. This allows for the cooling and lubrication of the shaft sealing device 56 and the sliding parts in the swash plate chamber 43 and the lubrication of the sliding surfaces of the inner surface of the secondary cylinder bore 50 and the second head 73.

In the compressor 10 of the present embodiment, the position of bottom dead center of the first head 71 of the double head piston 70 in the primary cylinder bore 45 is constant regardless of the inclination of the swash plate 65. The position of the top dead center of the first head 71 changes in accordance with the inclination of the swash plate 65. The position of the top dead center of the second head 73 in the secondary cylinder bore 50 is constant regardless of the inclination of the swash plate 65. The position of bottom dead center of the second head 73 changes in accordance with the inclination of the swash plate 65. Thus, the top dead center of the first head 71 in the first compression chamber 72 moves over a greater distance than the top dead center of the second head 73 in the second compression chamber 74.

The advantages of the compressor 10 of the present embodiment will now be described.

(1) During a large displacement operation, the refrigerant drawn into the first compression chamber 72 is hardly heated since the refrigerant does not flow through an area including heat sources, such as the swash plate chamber 43, which includes the swash plate 65, and the second suction chamber 32, which faces the shaft sealing device 56. This minimizes increases in the refrigerant temperature. As a result, the refrigerant can be compressed in the first compression chamber 72 with high compression efficiency. Further, a small amount of refrigerant is drawn into, compressed, and discharged from the second compression chamber 74 during the minimum displacement operation. This maintains a flow of refrigerant through the suction port 28, the first suction passage 29, the first suction chamber 17, and the second suction passage 49 into the second suction chamber 32. The refrigerant and the lubricating oil suspended in the refrigerant cool and lubricate the sliding parts in the swash plate chamber 43, which is a part of the second suction passage 49, and the shaft sealing device 56, which faces the second suction chamber 32. Thus, the lubrication and cooling of the sliding parts in the swash plate chamber 43 and the shaft sealing device 56 are ensured over the entire operation range from large displacement operation to minimum displacement operation.

(2) The swash plate chamber 43 forms part of the second suction passage 49. The swash plate chamber 43 functions as a muffler and suppresses pulsation caused by the self-induced vibration of the primary suction valve 25 and the secondary suction valve 40 during relatively smaller displacement operation.

(3) The secondary suction valve 40 has a greater open degree than the primary suction valve 25. This facilitates the suction of the refrigerant into the second compression chamber 74 from the second suction passage 49 even when the distance between the suction port 28 and the second compression chamber 74 is greater than the distance between the suction port 28 and the first compression chamber 72. This maintains a balance between the amounts of refrigerant drawn into the first compression chambers 72 and the second compression chamber 74.

It should be apparent to those skilled in the art that the present invention may be embodied in many other specific forms without departing from the spirit or scope of the invention. Particularly, it should be understood that the present invention may be embodied in the following forms.

In the above embodiment, the secondary suction valve 40 has a greater maximum open degree than the primary suction valve 25 to facilitate the suction of the refrigerant into the second compression chamber 74 from the second suction passage 49. However, the present invention is not limited to such a structure. For example, the primary suction valve 25 and the secondary suction valve 40 may have the same open degree. The suction of refrigerant into the second compression chamber 74 from the second suction passage 49 may be facilitated by setting the inside diameter of the secondary suction port 37 to be greater than the inside diameter of the primary suction port 22. Alternatively, both the open degree of the secondary suction valve 40 and the inside diameter of the secondary suction port 37 may be greater than the open degree of the primary suction valve 25 and the inside diameter of the primary suction port 22, respectively.

In the above embodiment, the swash plate chamber 43 forms a part of the second suction passage 49. However, it is not necessary that the second suction passage 49 includes the swash plate chamber 43. For example, a second suction passage may be formed that does not include the swash plate chamber 43.

The present examples and embodiments are to be considered as illustrative and not restrictive and the invention is not to be limited to the details given herein, but may be modified within the scope and equivalence of the appended claims.

The invention claimed is:

1. A variable displacement swash plate compressor comprising:

a housing including a cylinder block having a cylinder bore and a swash plate chamber, a first housing member coupled to one of opposite ends of the cylinder block, and a second housing member coupled to the other end of the cylinder block;

a drive shaft rotatably supported in the housing;

a link mechanism that rotates integrally with the drive shaft;

a swash plate accommodated in the swash plate chamber and adapted to rotate when receiving driving force from the drive shaft through the link mechanism, wherein an inclination angle of the swash plate to the drive shaft is variable;

a double head piston that is movably arranged in the cylinder bore and adapted to reciprocate in the cylinder bore and compress refrigerant when the swash plate rotates, wherein the double head piston includes a first end that defines a first compression chamber in the cylinder bore and a second end that defines a second compression chamber in the cylinder bore;

a first suction chamber that is located in the first housing member and in communication with the first compression chamber;

a second suction chamber that is arranged in the second housing member and in communication with the second compression chamber, wherein the drive shaft includes an input end section extending from the second suction chamber toward outside of the second housing member; and a shaft sealing device that is arranged between the input end section of the drive shaft and the second housing member and adapted to limit leakage of refrigerant out of the second housing member from the second suction chamber, wherein the link mechanism is adapted to support the swash plate in a manner that allows for variation in the inclination angle of the swash plate, according to the variation in the inclination angle of the swash plate, a top dead center of the double head piston in the first compression chamber is displaced and a top dead center of the double head piston in the second compression chamber is displaced, and the displacement of the top dead center in the first compression chamber is greater than the displacement of the top dead center in the second compression chamber, and the variable displacement swash plate compressor further comprises:

a housing suction port located in the housing, wherein refrigerant is drawn into the housing through the housing suction port from outside of the housing;

a first suction passage extending from the housing suction port to the first suction chamber without passing through the second suction chamber and the swash plate chamber; and a second suction passage extending from the first suction chamber to the second suction chamber.

2. The variable displacement swash plate compressor according to claim 1, wherein the swash plate chamber forms part of the second suction passage.

3. The variable displacement swash plate compressor according to claim 1, further comprising:

a first valve plate arranged between the first compression chamber and the first suction chamber;

a first valve-plate suction port arranged in the first valve plate to communicate the first compression chamber and the first suction chamber;

a first suction valve that opens and closes the first valve-plate suction port;

a second valve plate arranged between the second compression chamber and the second suction chamber;

a second valve-plate suction port arranged in the second valve plate to communicate the second compression chamber and the second suction chamber; and a second suction valve that opens and closes the second valve-plate suction port, wherein the variable displacement swash plate compressor satisfies at least one of the following conditions:

a maximum open degree of the second suction valve is greater than a maximum open degree of the first suction valve; and an inside diameter of the second valve-plate suction port is greater than an inside diameter of the first valve-plate suction port.

* * * * *